United States Patent [19]

Mori

[11] Patent Number: 4,991,843

[45] Date of Patent: Feb. 12, 1991

[54] GOLF CLUB WITH A PLASTIC HEAD

[75] Inventor: Masahiro Mori, Matsudo, Japan

[73] Assignee: Maruman Golf Co., Ltd., Tokyo, Japan

[21] Appl. No.: 327,670

[22] Filed: Mar. 23, 1989

[30] Foreign Application Priority Data

Apr. 8, 1988 [JP] Japan ..... 63-46769

[51] Int. Cl.[5] ..... A63B 53/04

[52] U.S. Cl. ..... 273/80.3; 273/80.8; 273/78

[58] Field of Search ..... 273/80 R, 80 C, 80.1–80.5, 273/167 R, 167 G, 167 H, 67 A, DIG. 8, DIG. 23, 78

[56] References Cited

U.S. PATENT DOCUMENTS

| | | | |
|---|---|---|---|
| 1,602,567 | 10/1926 | Colwell | 273/78 |
| 1,651,843 | 12/1927 | Sime | 273/80.3 |
| 1,844,812 | 2/1932 | Thorpe | 273/80.5 |
| 3,873,090 | 3/1975 | Thompson | 273/80.8 |
| 4,113,249 | 9/1978 | Beery | 273/78 |
| 4,582,321 | 4/1986 | Yoneyama | 273/78 |
| 4,664,383 | 5/1987 | Aizawa | 273/78 |

FOREIGN PATENT DOCUMENTS

| | | | |
|---|---|---|---|
| 332354 | 7/1930 | United Kingdom | 273/80.3 |
| 397252 | 8/1933 | United Kingdom | 273/80.8 |
| 955212 | 4/1964 | United Kingdom | 273/80.8 |

*Primary Examiner*—Edward M. Coven
*Assistant Examiner*—Sebastiano Passaniti
*Attorney, Agent, or Firm*—Armstrong, Nikaido, Marmelstein, Kubovcik & Murray

[57] ABSTRACT

A head of a golf club comprising a metal core member and an outer member of a plastic or a fiber reinforced plastic material fitted over the metal core member. The metal core member includes a neck portion integrally extending from a core body portion thereof for connecting to the shaft. The plastic outer member includes at least a hitting portion and a neck portion partially covering the neck portion of the core member, whereby a free end of the neck portion of the metal core member is protruded therefrom. The outer member is formed by molding while the core member is inserted therein. A cylindrical socket can be fitted on the protruding free end portion of the neck portion of the metal core member.

9 Claims, 2 Drawing Sheets

GOLF CLUB WITH A PLASTIC HEAD

BACKGROUND OF THE INVENTION

1. Field of the Invention

The present invention relates to a golf club with a head made of a plastic material, or a fiber reinforced plastic material, fitted to a metal core member.

2. Description of the Related Art

Recently, proposals have been made for a golf club having a head made of a plastic material, or a fiber reinforced plastic material, and such golf club head is known, for example, as a "carbon head". This type of plastic golf club head is light in weight and can be easily formed into a desired shape, and usually, a metal core member is incorporated in the plastic golf club head to adjust the center of gravity and increase the rigidity of the head. For this purpose, the metal core member is formed in a shape of a core body portion and a neck portion integrally extending from the core body portion. The plastic head is formed by molding the plastic material together with the metal core member inserted therein, whereby the plastic outer member is molded around the metal core member. In many cases, the plastic outer member fully covers the metal core member except at the sole portion of the head. Namely, the hitting portion is constituted by the plastic outer member and the sole portion is a part of the metal core member. The neck portion of the metal core member is fully covered by the plastic outer member.

An example of a conventional plastic head is shown in FIG. 5, in which the head 1 comprises a hitting portion la and a neck portion lb and is fitted to a shaft 2. The metal core member is composed of a core body portion 3*a*, a neck portion 3*b* and a sole portion 3*c*. A plastic or fiber reinforced plastic outer member 4 covers the metal core member portions 3*a* and 3*b* but does not cover the sole portion 3*c*. A bore 5 is provided in the neck portion 3*b* of the metal core member and a plastic socket 6 is fitted on the shaft 2 and abuts against the upper end of the neck portion 1*b* of the head.

In the manufacture of a golf club, it is sometimes necessary to adjust the loft angle and lie angle of the club head by bending the neck portion of the club head after the club head has been made. Accordingly, a problem arises in the above described plastic head having a composite structure, in that the plastic or fiber reinforced plastic outer member is separated at the neck portion of the metal core member when the neck portion of the club head is bent for adjustment or damaged by the clamping force used when bending the neck portion.

SUMMARY OF THE INVENTION

An object of the present invention is to provide a golf club with a head made of a plastic material, or a fiber reinforced plastic material, fitted to a metal core member, in which the neck portion can be easily bent for adjustment of a loft angle and lie angle thereof without a separation of or damage to the outer plastic member.

According to the present invention, there is provided a golf club comprising a head and a shaft connected to the head. The head comprises a metal core member including a core body portion and a neck portion integrally extending from the core body portion, and an outer member of a plastic or a fiber reinforced plastic material fitted to the core body portion of the metal core member to constitute at least a hitting portion for hitting a golf ball, and a neck portion integrally extending from the hitting portion to cover the neck portion of the metal core member. The neck portion of the metal core member has a bore formed therein to a length required for a firm insertion of the shaft. The neck portion of the plastic outer member has a length smaller than that of the neck portion of the metal core member and thus a free end of the neck portion of the metal core member protrudes from the neck portion of the plastic outer member.

With this arrangement, it is possible to bend the protruding free end portion of the neck portion of the metal core member without imposing any substantial force on the neck portion of the plastic outer member, when adjusting a loft angle and a lie angle and thus separation of or damage to the outer plastic member will be alleviated and the appearance of the plastic head is from the hitting portion to the neck portion will remain unchanged.

Preferably, a cylindrical socket is fitted on the protruding free end portion of the neck portion of the metal core member, and extends from the protruding free end portion of the neck portion of the metal core member to the shaft of the golf club.

Also preferably, the neck portion of the plastic outer member extends to a point close to the bottom of the bore of the neck portion of the metal core member, preferably on the side of the core body portion.

Further preferably, the neck portion of the metal core member has an annular groove on the outer surface thereof close to the bottom of the bore, and a cylindrical socket fitted on the protruding free end portion of the core neck portion is provided with an inner annular flange for engagement with the annular groove of the neck portion of the metal core member.

BRIEF DESCRIPTION OF THE DRAWINGS

The other objects and features of the present invention will become apparent from the following description of the preferred embodiments with reference to the accompanying drawings, in which.

DESCRIPTION OF THE PREFERRED EMBODIMENTS

Figure 1:
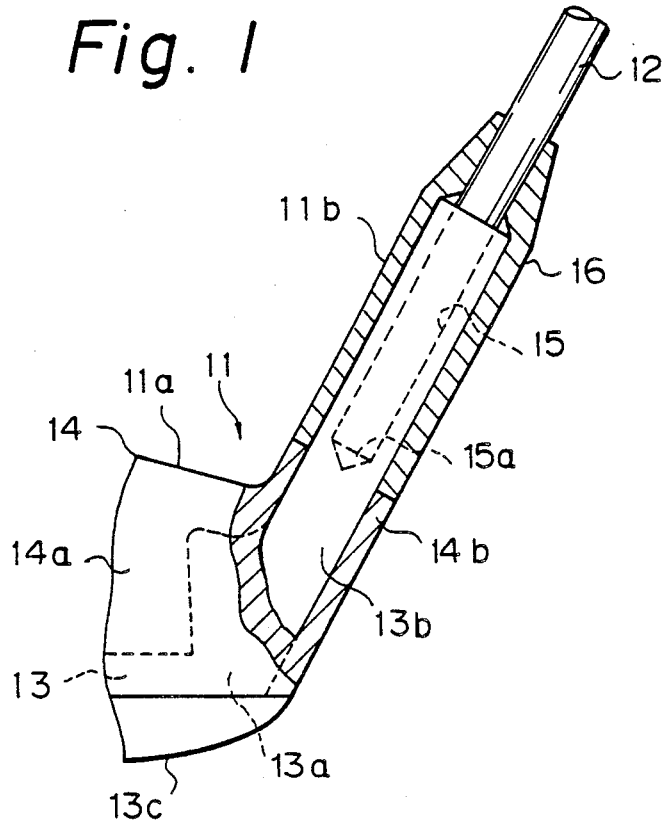
FIG. 1 is a perspective partial sectional view of a golf club according to the present invention, showing only a part of a head and a neck portion.
Figure 2:
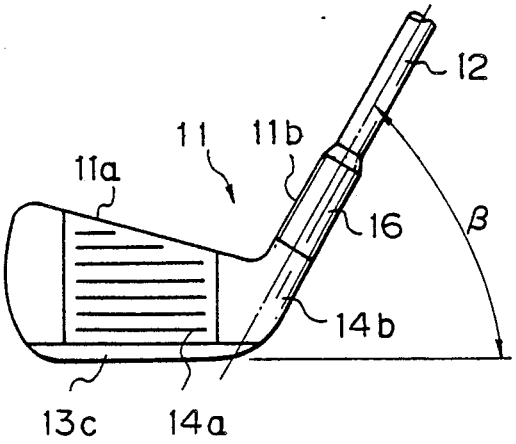
FIG. 2 is a front view of the golf club of FIG. 1.
Figure 3:
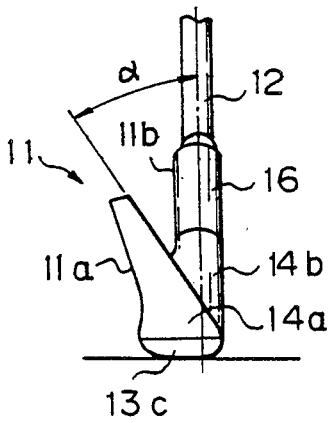
FIG. 3 is a side view from the toe side of the golf club of FIG. 1.

FIGS. 1 to 3 show an iron type golf club having a head 11 and a shaft 12. The head 11 comprises a hitting portion 11*a* and a neck portion 11*b*, and the shaft 12 is connected to this neck portion 11*b*. The head 11 has a composite structure composed of a core member 13 and an outer member 14 fitted to the core member 13. The core member 13 is made of a metal, for example, stainless steel, iron or copper alloy or the like, and the outer member 14 is made of a plastic, or fiber reinforced plastic, for example, ABS, nylon resin, epoxy resin, carbon fiber or glass fiber reinforced nylon resin or epoxy resin, or the like.

The core member 13 is an integral unit composed of a core body portion 13*a*, a neck portion 13*b*, and a sole portion 13c located below the core body portion 13a. The core body portion 13a generally extends from the toe to the heel of the head 11 and the neck portion 13b extends obliquely upwardly from the heel of the core body portion 13a. A bore 15 is provided in the neck portion 13b for insertion of the shaft 12, which bore 15 extends axially along the center axis of the neck portion 13b and has a bottom 15a at a required length from the open end thereof.

The outer member 14 is an integral unit composed of a hitting portion 14a for hitting a golf ball, and a neck portion 14b. The hitting portion 14a covers the core body portion 13a but does not cover the sole portion 13c, and the neck portion 14b partly covers the neck portion 13b. Namely, the neck portion 14b of the outer member 14 has a length smaller than that of the neck portion 13b of the metal core member 13, and thus a free end portion of the neck portion 13b of the metal core member 13 protrudes from the neck portion 14b of the outer member 14. Preferably, the neck portion 14b of the outer member 14 extends to a point close to and slightly below the bottom 15a of the bore 15 of the neck portion 13b of the metal core member 13.

A cylindrical socket 16 is fitted on the protruding free end portion of the neck portion 13b of the metal core member 13, and extends from the upper end of the neck portion 13b to the shaft 12. The cylindrical socket 16 can be made of, for example, ABS, nylon resin, epoxy resin, or fiber reinforced plastic, but is preferably a soft base component resin.

In the manufacture of the golf club, the metal core member 13 with the integral portions 13a and 13b can be made by, for example, a lost wax process. Then the plastic or fiber reinforced plastic material for the outer member 14 is heated and poured into a mold and the core member 13 is inserted therein in such a manner that the hitting portion 14a and the neck portion 14b of the outer member 14 cover the core body portion 13a and the root part of the neck portion 13b of the core member 13, respectively, but the sole portion 13c and the free end portion of the neck portion 13b are not covered. It is possible at this time to adjust a loft angle $\alpha$ (see FIG. 3) and a lie angle $\beta$ (see FIG. 2) by slightly bending the neck portion 13b of the core member 13 as required This bending can be carried out substantially in the region of the protruding end portion of the neck portion 13b of the core member 13, whereby little force is exerted on the neck portion 14b of the outer member 14, and thus separation of or damage to the outer plastic member 14 is prevented.

In the structure having the bore 15, the neck portion 13b of the core member 13 will bend more at the region near to the bottom 15a of the bore 15, and thus the neck portion 14b of the outer member 14 is even less affected by the bending of the neck portion 13b, and thus separated of or damage to the outer plastic member 14 is further prevented if the neck portion 14b of the outer member 14 does not reach the bottom 15a on the side of the core body portion 13a.

Then the shaft 12 is inserted in the bore 15 of the neck portion 13b of the core member 13 and fixed therein by, for example, an adhesive or a pin, and the cylindrical socket 16 is fitted on the protruding end of the neck portion 13b of the core member 13 and on the shaft 12. The cylindrical socket 16 can be fitted onto the cylindrical socket 16 on the shaft 12 prior to the insertion of the shaft 12 in the bore 15, and the cylindrical socket 16 slid over the protruding end of the neck portion 13b of the core member 13 after the shaft 12 is fixed. Alternatively, the cylindrical socket 16 can be first fitted onto the protruding end of the neck portion 13b of the core member 13 and the shaft 12 then fixed to the neck portion 13b of the core shaft 12 in the bore 15.

If the cylindrical socket 16 is fitted to the protruding end of the neck portion 13b of the core member 13, the appearance of the head will be improved. Further, the shaft 12 may be reinforced by extending the cylindrical socket 16 from the protruding end of the neck portion 13b to the shaft 12 and the appearance is improved by tapering the upper end of the cylindrical socket 16.

Figure 4:
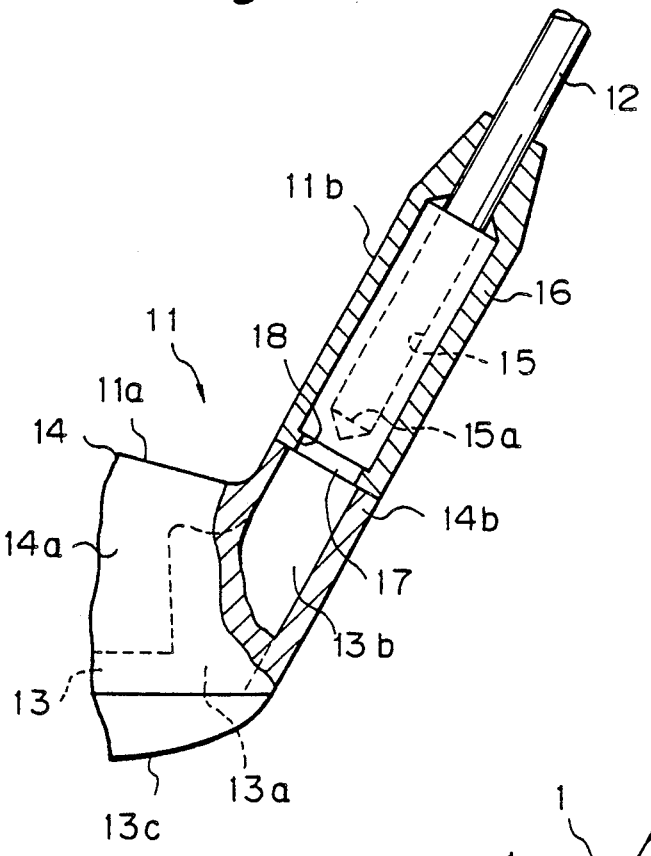
FIG. 4 is a view similar to FIG. 1 and showing another embodiment of the present invention; and, FIG. 5 is a view of a conventional golf club.
Figure 5:
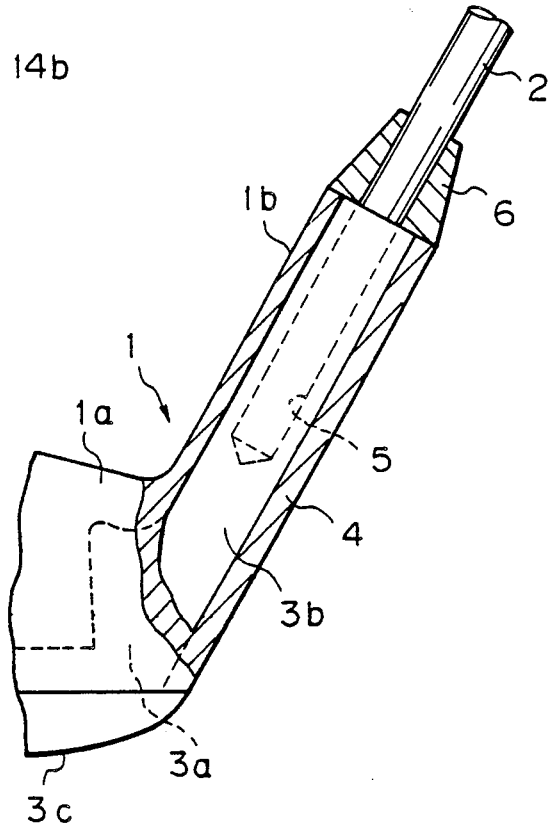
Fig. 5 PRIOR ART

FIG. 4 shows the second embodiment of the present invention, wherein parts similar to those of the previous embodiment are represented by the same reference numerals.

In this embodiment, an annular groove 17 is provided on the outer surface of the neck portion 13b of the core member 13 at a point close to the bottom 15a of the bore 15 on the side of the core body portion 13a, and accordingly, the neck portion 13b of the core member 13 will bend more at the region of the annular groove 17 of the neck portion 13b of the metal core member 13. Also, the cylindrical socket 16 is provided with an inner annular flange 18 for engagement with the annular groove of the neck portion 13b of the metal core member 13, to prevent accidental separation of the cylindrical socket 16 from the neck portion 13b.

It will be understood that, although the above description is made with reference to the drawings, the present invention is not restricted to the described examples and modifications thereto can be made, for example, the shapes of the elements, manner of connection, and materials. It is also possible to apply the present invention to a wood type golf club as well as to an iron type golf club.

I claim:

1. A golf club comprising a head and a shaft connected to said head, said head comprising a metal core member including a metal core body portion and a first metal neck portion integrally extending from said metal core body portion, and an outer member of a plastic or a fiber reinforced plastic material covering a substantial part of said metal core body and a bottom part of said first metal neck portion for constituting at least a of said metal core member) for constituting at least a hitting portion for hitting a golf ball and a second neck portion integrally extending from said hitting portion to cover said bottom part of said first metal neck portion of said metal core member such that a substantial part of said first metal neck portion extends outside from said second neck portion to form a free end without being covered by said second neck portion, said free end of said first metal neck portion of said metal core member having a bore formed therein for insertion of said shaft, said bore, extending from a tip end of said free end to a position where a tip end of said second neck portion is positioned such that said free end can be bent in order to adjust an angle of said shaft with respect to said head without causing damage to said second neck portion.

2. A golf club according to claim 1, wherein said plastic outer member is molded while said core member is inserted therein.

3. A golf club according to claim 2, wherein a cylindrical socket is fitted on the free end of said first metal neck portion of said metal core member after said plastic outer member is molded.

4. A golf club according to claim 3, wherein said socket extends from said free end of said first metal neck portion of said metal core member to said shaft.

5. A golf club according to claim 1, wherein said bore of said first metal neck portion of said metal core member has a bottom, said second neck portion of said outer member extending to a point close to said bottom of said bore of said first metal neck portion of said metal core member.

6. A golf club according to claim 1, wherein said bore of said first metal neck portion of said metal core member has a bottom and said first metal neck portion of said metal core member has an annular groove on the outer surface thereof close to said bottom of said bore of said first metal neck portion of said metal core member.

7. A golf club according to claim 6, wherein said annular groove of said first metal neck portion of said metal core member is provided close to said bottom of said bore on the side of said core body portion.

8. A golf club according to claim 6, wherein a cylindrical socket is fitted on the free end of said first metal neck portion of said metal core member and is provided with an inner annular flange for engagement with said annular groove of said first metal neck portion of said metal core member.

9. A golf club according to claim 1, wherein said core body portion of said metal core member constitutes a sole portion of said head not covered by said plastic outer member.

* * * * *